US005628398A

United States Patent [19]

Jackson

[11] Patent Number: 5,628,398

[45] Date of Patent: May 13, 1997

[54] ANTHROPOMORPHIC TRAVEL SYSTEM

[76] Inventor: W. Shaun Jackson, 301 Golfview La., Ann Arbor, Mich. 48103

[21] Appl. No.: 496,951

[22] Filed: Jun. 30, 1995

[51] Int. Cl.[6] ..... A45C 5/12; A45C 13/28; B65D 85/18

[52] U.S. Cl. ..... 206/287.1; 206/279; 206/289; 190/109; 190/110; 383/23

[58] Field of Search ..... 190/109, 110; 383/23; 224/257, 258; 206/279, 287, 287.1, 289; 223/88, 98

[56] References Cited

U.S. PATENT DOCUMENTS

| | | | |
|---|---|---|---|
| Re. 34,474 | 12/1993 | Lutz | 206/287.1 X |
| D. 349,410 | 8/1994 | Morales-Rivera | D6/316 |
| 1,273,201 | 7/1918 | Teuber | 224/257 X |
| 2,710,638 | 6/1955 | Ford | 383/23 |
| 3,175,658 | 3/1965 | Bierman | 190/110 |
| 3,378,180 | 4/1968 | Singer | 223/87 |
| 3,433,335 | 3/1969 | Spitz | 190/109 X |
| 3,448,839 | 6/1969 | Lugash | 206/287 |
| 3,559,777 | 2/1971 | Gardner | 190/109 X |
| 3,704,778 | 12/1972 | Raschdorf | 206/287 |
| 3,809,194 | 5/1974 | Chappelle et al. | 206/287 |
| 3,929,224 | 12/1975 | Smith, Jr. | 383/23 |
| 4,091,976 | 5/1978 | Morse | 206/279 X |
| 4,189,036 | 2/1980 | Pelavin | 206/278 |
| 4,282,911 | 8/1981 | Sumitomo | 383/23 X |
| 4,342,479 | 8/1982 | Hofer | 206/287 X |
| 4,391,396 | 7/1983 | Brady | 206/287 X |
| 4,620,651 | 11/1986 | Spies | 223/88 |
| 4,711,383 | 12/1987 | Jenkins | 224/202 |
| 4,947,987 | 8/1990 | Keenan | 206/278 X |
| 5,065,864 | 11/1991 | Schmitt | 206/287 X |
| 5,117,974 | 6/1992 | Bieber | 206/278 |
| 5,509,588 | 4/1996 | Kimball | 206/286 X |

FOREIGN PATENT DOCUMENTS

| | | | |
|---|---|---|---|
| 3602216 | 2/1987 | Germany | 190/109 |
| 1190489 | 5/1970 | United Kingdom | 190/109 |

*Primary Examiner*—Sue A. Weaver
*Attorney, Agent, or Firm*—Gifford, Krass, Groh, Sprinkle, Patmore, Anderson & Citkowski

[57] ABSTRACT

An anthropomorphic travel system includes a fillable module, the shape of which approximates the upper shoulder area of a human torso, enabling a coat or like garment to be carried over and along with the module so as to minimize wrinkling of the garment. In the preferred embodiment this module is multi-compartmentalized, and includes a bottom portion with a pair of spaced-apart hooks which extend downwardly therefrom, the hooks being adapted to releasably grasp the bottom member of a clothes hanger to carry a garment secured thereto. The module also includes a back surface from which there extends downwardly a flexible, compartmentalized panel such that even when the module and panel with overdraping garment(s) are covered with an outer bag, the entire system may be folded in half lengthwise and secured in that state for compact transport while continuing to minimize wrinkling of the garment(s).

9 Claims, 5 Drawing Sheets

ANTHROPOMORPHIC TRAVEL SYSTEM

FIELD OF THE INVENTION

The present invention relates generally to luggage, and, more particularly, to a travel system particularly suited to one or a few nights on the road.

BACKGROUND OF THE INVENTION

Many business travelers take trips which last only one or two nights. A familiar sight is the salesman, traveling down the road with a hanging suit bag visible through the window of the car. Typically such individuals take one suit, a clean shirt, underwear and toiletries for an overnight trip.

The typical garment bag weighs in the range of 7 to 10 lbs, whereas, on a business trip, the traveler may be carrying between 4 and 6 lbs. of clothing. Accordingly, to ensure that these short-trip travelers do not carry more luggage than personal belongings, an ongoing challenge is to reduce weight while maximizing all available space. At the same time, however, in the typical garment bag a large percentage of the available space has already been accounted for, with over-the-shoulder corner pockets, mesh organizer panels, and multiple exterior pockets to compartmentalize the load. A point of diminishing returns may be encountered with such multi-compartmentalization as well, in that with an excess of pockets, particularly opaque pockets, the traveller may forget what has been put where.

SUMMARY OF THE INVENTION

One space which has not been effectively utilized in the typical garment bag is the volume defined by the hanging garment itself. The present invention not only takes advantage of this otherwise unused volume, but does so with a fillable module which approximates the human form, thereby protecting garments placed over this form from wrinkling. In particular, the shape of this module approximates the upper shoulder area of a human torso, enabling a coat or like garment to be carried over and along with the module. In the preferred embodiment the module is multi-compartmentalized, and includes a bottom portion with a pair of spaced-apart hooks which extend downwardly therefrom, the hooks being adapted to releasably grasp the bottom member of a clothes hanger to carry a garment secured thereto. The module preferably also includes a back surface from which there extends downwardly a flexible, compartmentalized panel such that even when the module and panel with overdraping garment(s) are covered with an outer bag, the entire system may be folded in half lengthwise and secured in that state for compact transport while continuing to minimize wrinkling of the garment(s).

The fillable module provides an upper apex region and preferably further includes grasping/carrying means pivotably secured proximate to the apex region. In one embodiment the carrying means involves shoulder strap having two outer edges of unequal length for better conformance to the slope of a user's shoulder, whereby, with the system covered and secured in a folded position as described above, it hangs substantially straight down from the shoulder strap, with the shape and construction of the strap and pivot point acting in concert to keep the system from falling off.

DETAILED DESCRIPTION OF THE PREFERRED EMBODIMENT

The present invention provides a consolidated travel bag with efficient compartmentalization, particularly for one or a few nights on the road. In addition, a primary fillable module of the system approximates the upper shoulder region of a human form, thereby further providing an arrangement over which a typical suit jacket or coat may be placed and covered to avoid garment wrinkling. The invention preferably makes use of a form large enough to accommodate a typical suit jacket, either for a man and a woman, enabling a typical plastic or fabric suit cover to be placed over the garment on the form.

Figure 1:
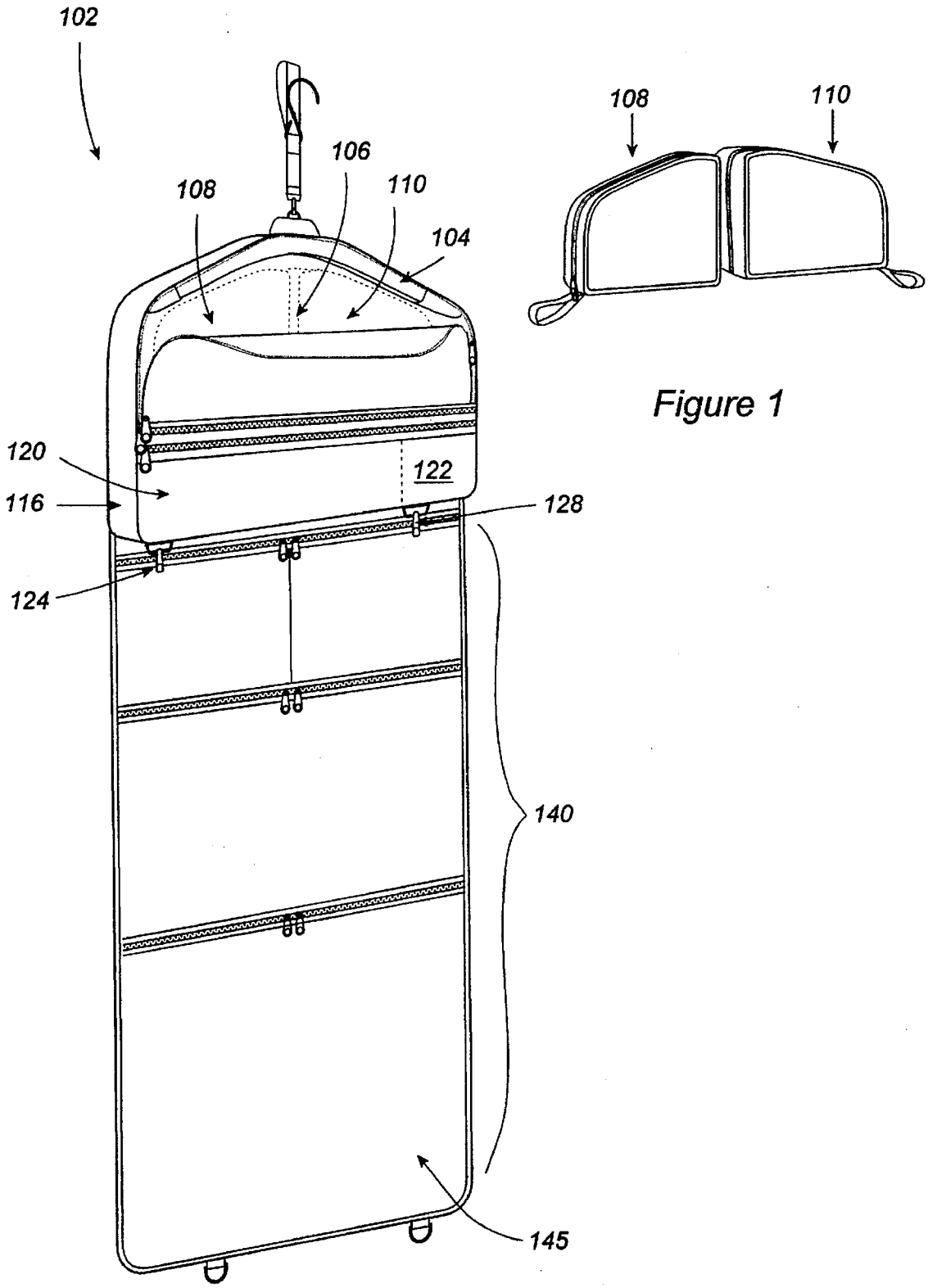
FIG. 1 is an oblique drawing of an embodiment of the invention including a fillable module having an anthropomorphic shape and an optional organizer panel extending downwardly therefrom.

FIG. 1 illustrates a preferred embodiment of the invention, the fillable module being shown generally at 102. In the preferred embodiment, one or more rigid or semi-rigid members are used for support at least along the upper edges of the module so as to maintain this upper shoulder/torso shape during use. In the preferred embodiment, a removable hanger 104 having opposing side arms is used for this purpose. When installed as shown, these side arms bear upwardly against the top, inner edges of the module, assisting them in assuming the generally downwardly gradual tapered slope of the upper shoulder area. It should be evident to one of ordinary skill that various other means may be used to provide this rigidity, including three-dimensional wire or plastic form, or flat, rigid or semi-rigid sheet stock which may or may not be embedded or sewn within the fabric used to construct the module proper. A top compartment 106 accommodates two zippered modules 108 and 110, either of which may function as a toilet kit to carry work-out clothes, or for other purposes. Either or both of the modules 108 and 110 are constructed of a strong, lightweight and preferably semi-transparent mesh, enabling the user to see the contents and to promote the drying of any residual moisture. Not only are the modules 108 and 110 shaped to fit neatly into the compartment 106, but they are preferably sized so that with their angled sides placed in abutting fashion (with point A meeting point B, for example), a rectangular shape results which conforms to the bottom dimensions of a conventional Pullman-style suitcase.

A compartment 116 is sized to accommodate a pair of shoes. The shoe compartment 116 is separate so if the shoes are soiled, they do not in any way compromise the contents of the top compartment 106. A small mesh panel 120 on the front may be used for ties, gloves, and the like, another small pocket 122 can be used for jewelry or other small items.

Figure 2:
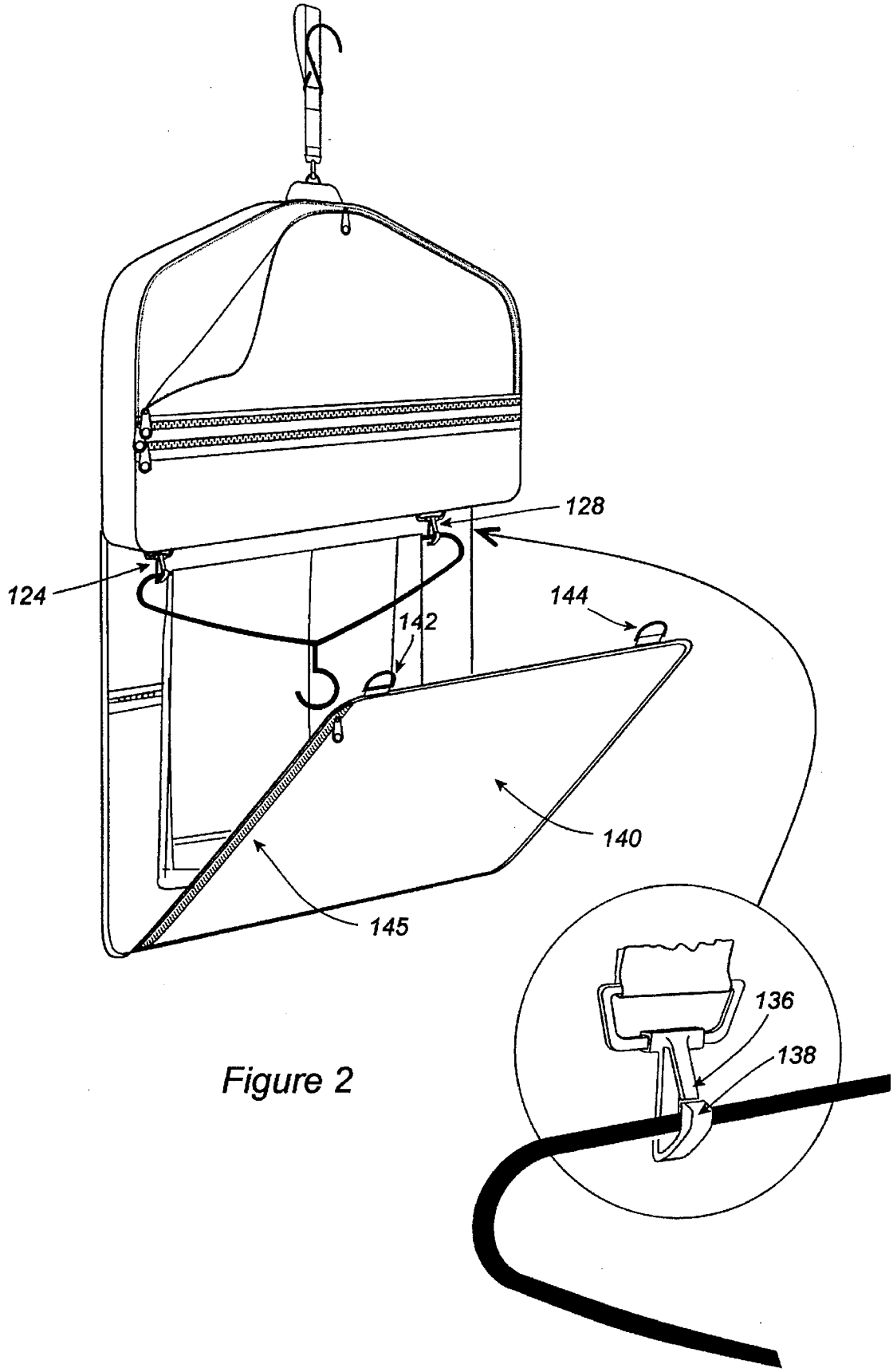
FIG. 2 is an oblique drawing of an embodiment of the invention including a fillable module and organizer panel shown in a partially folded condition.
Figure 3:
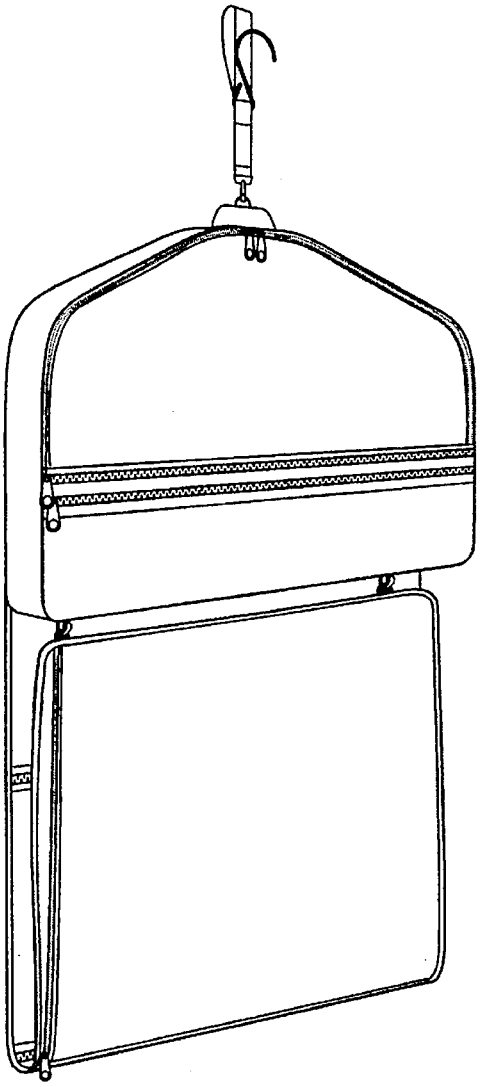
FIG. 3 is an oblique drawing of the embodiment of FIG. 2, wherein the organizer panel is more completely folded and snapped into position using a pair of inventive hooks.
Figure 4:
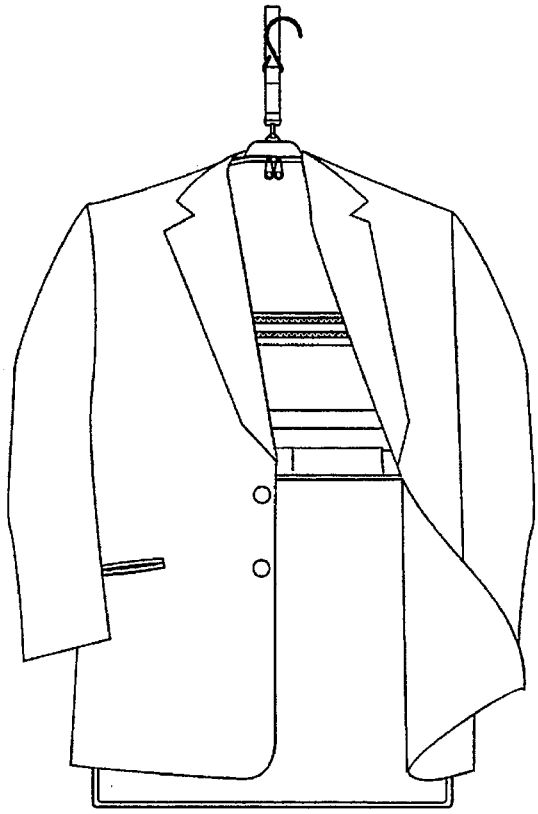
FIG. 4 is a front-view of an embodiment of the invention over which a suit jacket has been placed, the anthropomorphic shape of the form assisting in minimizing wrinkling of the garment.
Figure 5:
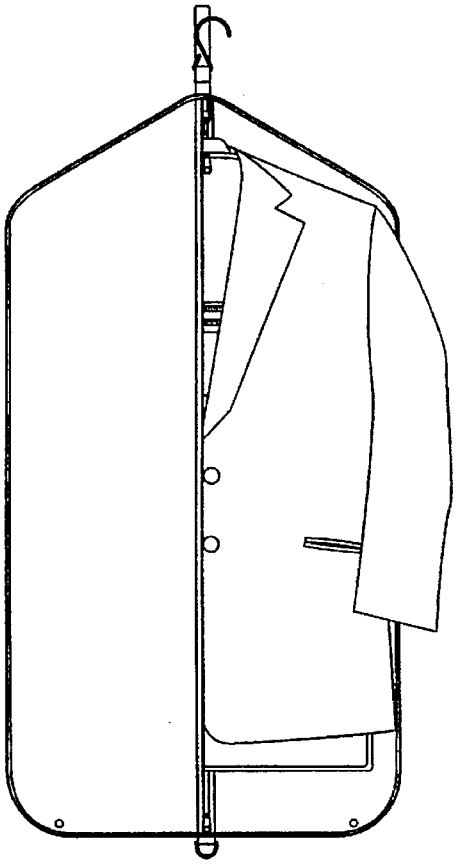
FIG. 5 is an oblique drawing which shows a zippered outer cover.

As shown in FIG. 2, to accommodate an extra pair of pants 130, or a skirt, two plastic snap hooks 124 and 128, permanently adjoined to the bottom edge of the hanger/organizer may be used to accommodate a typical pane or skirt hanger 132, permitting such a garment to simply snap in on either side. As snap hooks typically exhibit a captive gate within the hook, the thickness of a hanger precludes the gate from opening once the hanger is in place. Therefore, in the preferred design, a gate 136 is formed at a close clearance with respect to the top portion 138 of the hook, so that it snaps in and out with ease. Once filled, the bottom portion 146 of the organizer may be folded up as shown, with rings 142 and 144 snapping into hooks 124 and 128 respectively, the resulting form being depicted in FIG. 3. Even loaded in this way, a typical suit jacket fits quite well over the entire form as shown in FIG. 4.

Figure 6:
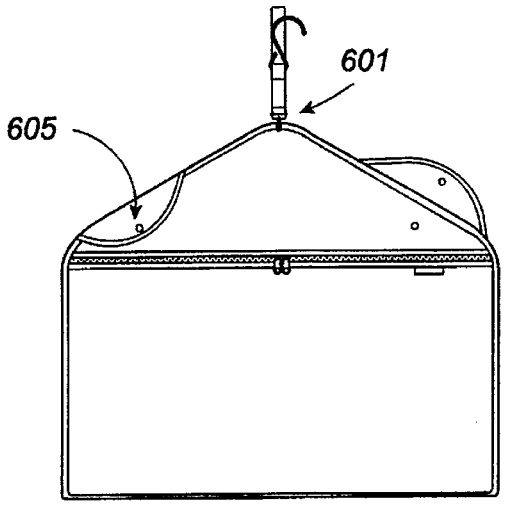
FIG. 6 is an oblique drawing which illustrates how the outer cover of FIG. 6 may be folded without other aspects of the invention contained therein.

This packed form may be used as an insert to a traditional garment bag, thus affording the additional organizational capabilities made possible by the invention. In place of a conventional plastic or fabric garment bag covering, however, the invention preferably uses a higher quality cover made from a military fabric of the type used for cold-air military balloons. This material is based on a rip-stop weave, not unlike the rip-stop fabric familiar to lightweight, high quality tents. But it uses 200-denier yarn, which is significantly stronger yet extremely lightweight. The preferred cover fits over the form in precisely the same way that the cover of a typical suit bag fits. The pants may be folded in and the bag zipped up, as shown in FIG. 6, resulting in an extremely compact, lightweight and very efficient travel system, sized to fit under the seat or in an overhead compartment on an aircraft.

In the preferred embodiment an organizer panel 140 extends from the bottom of the top compartment as shown in FIG. 1. This panel is specifically designed to accommodate those items taken on a business trip: socks, underwear, workout clothes, laundered shirts, etc. On the lower part of the organizer panel there is an envelope pocket, the zippered entrance to which is shown at 145 in FIG. 2. This pocket is specifically designed to hold dirty clothes which might accumulate while traveling.

Figure 9:
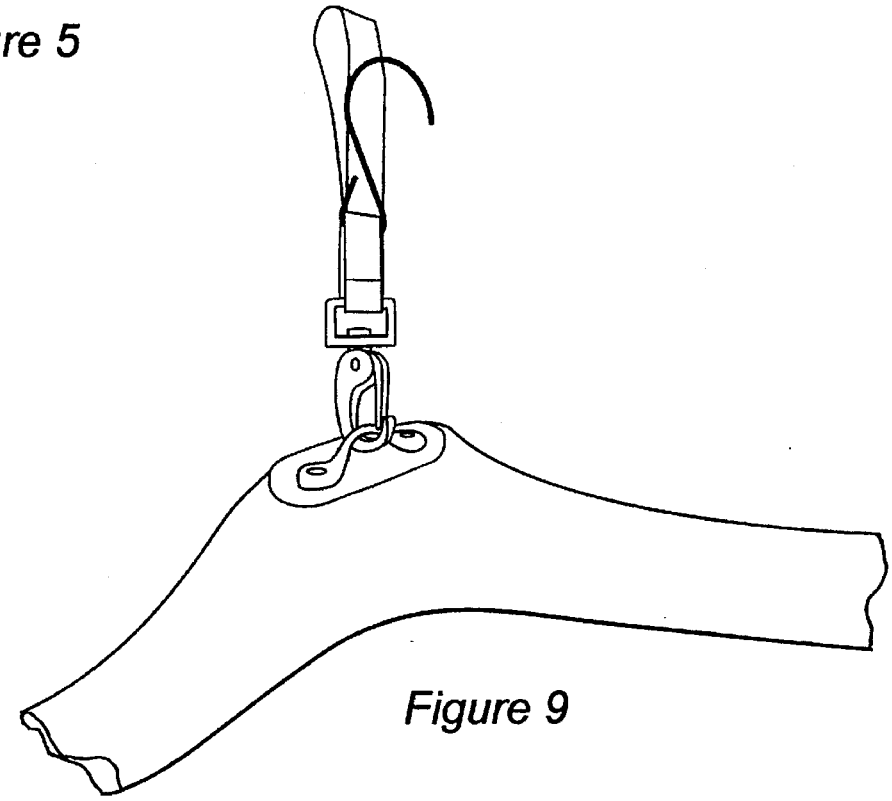
FIG. 9 is a close-up drawing of an alternative strap and hook carrying and hanging arrangement.
Figure 7:
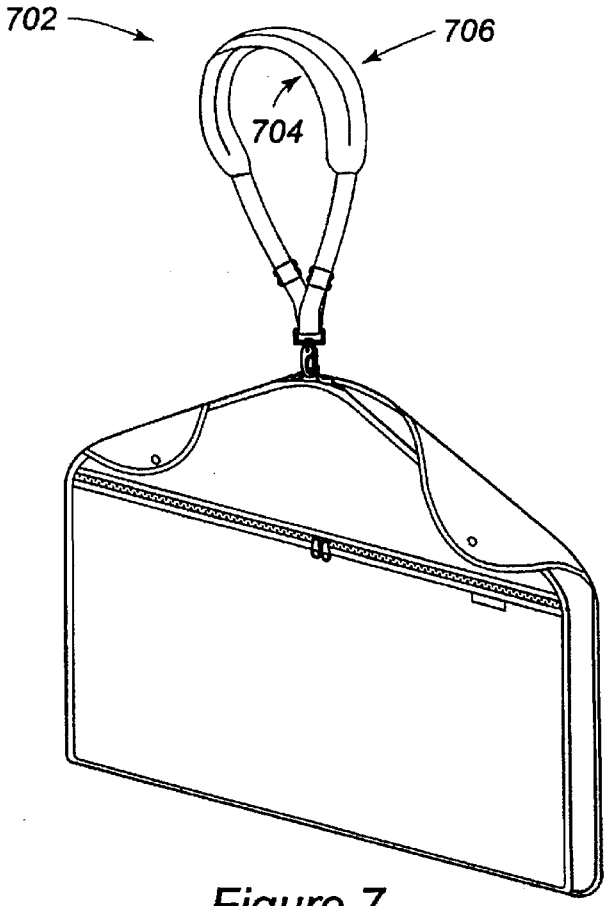
FIG. 7 is an oblique representation of the upper portion of a covered embodiment of the invention used to show how carrying means may be pivotably attached at a single, upper apex region.
Figure 8:
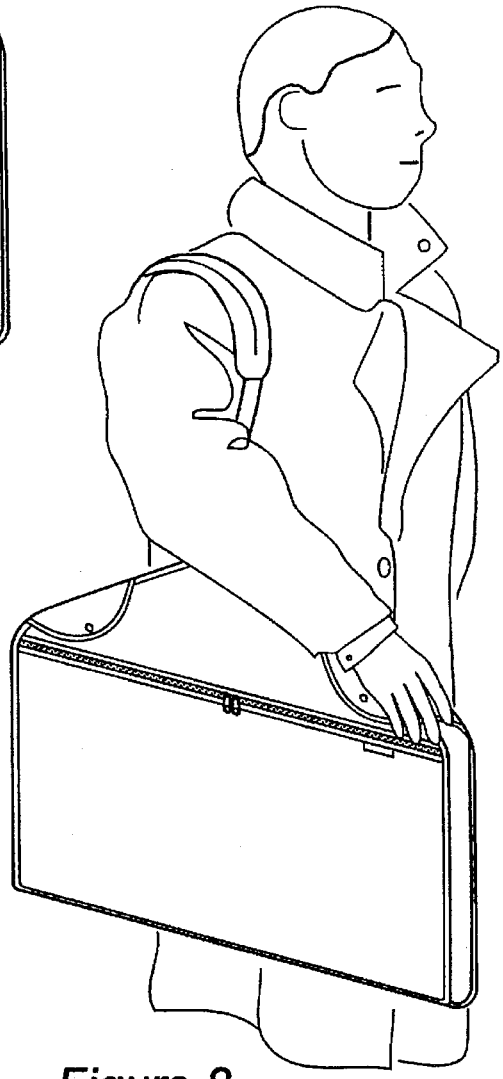
FIG. 8 is an oblique drawing of an individual carrying an embodiment of the invention contained in a folded outer cover, and having a non-slip shoulder strap pivotably connected thereto.

Typically, on almost all shoulder bags, the straps are attached on top opposing edges of the exterior. However, in the preferred embodiment, the carrying means are attached at a single point 601, as shown in FIG. 6 and in certain of the other figures. This provides several advantages over these traditional opposing edge attachment schemes. For one, it enables the bottom edges of the outer covering to be folded over and snapped as shown at 605 in FIG. 6. There are at least two aspects of the inventive shoulder strap configuration which assist in stabilizing the system onto a user's shoulder. For one, the point 601 where the strap connects to the upper apex area of the travel system is a pivoting connection, enabling the bag to move under the arm of a user without disturbing the position of the strap itself. In addition, as depicted in FIG. 7, the strap, shown generally at 702, includes edges 704 and 706 which are dissimilar in length, resulting in a shape which conforms to the generally downwardly tapering slope of a user's shoulder. These physical considerations, in conjunction with the use of a non-slip padding on the underside of the strap, act in concert to keep the travel system in place. As an alternative to the shoulder strap, a dedicated hook and handle mechanism may be utilized as shown in FIG. 9. On the outside of the outer cover there has been placed an optional pocket 802 to facilitate carrying a newspaper, plane ticket, or other items for ready accessibility.

What is claimed:

1. A travel system, comprising:

a fillable module constructed of a flexible sheet material, the module having a back surface, a front surface and a surrounding edge defining a fillable volume, the front surface including means for gaining access to the interior of the volume, the module further including an upper portion with a centralized upper apex area with carrying means pivotably attached thereto, the edges on either side of the apex area sloping gradually downwardly, resulting in an outer module volume which, when sufficiently filled, approximates the upper chest and shoulder areas of a human form, the bottom edge of the module defining a horizontal fold region immediately therebelow;

a flexible organizer panel extending downwardly from the back surface of the fillable module, the organizer panel including a plurality of user-accessible pockets;

an outer covering having upper and lower portions and a length sized to enclose the fillable module and flexible organizer panel; and means for releasably attaching the upper and lower portions of the covering when brought proximate to one another upon folding along the horizontal fold region, thus enabling a coat or like garment to be placed over the resulting human form and folded in a manner which minimizes wrinkling of the garment during travel.

2. The travel system of claim 1, the fillable module being multi-compartmentalized.

3. The travel system of claim 1, further including a hook and carrying strap both pivotably attached at a single point associated with the apex area.

4. The travel system of claim 1, the carrying means including a shoulder strap having two outer edges of unequal length for better conformance to the slope of a user's shoulder.

5. A travel system, comprising:

a fillable module constructed of a flexible sheet material, the module having a back surface, a front surface and a surrounding edge defining a fillable volume, the front surface including means for gaining access to the interior of the volume, the module further including an upper portion with a centralized upper apex area with carrying means pivotably attached thereto, the edges on either side of the apex area sloping gradually downwardly, resulting in an outer module volume which, when sufficiently filled, approximates the upper chest and shoulder areas of a human form, the bottom edge of the module defining a horizontal fold region immediately therebelow;

a pair of spaced-apart hooks which extend downwardly from the bottom edge of the fillable module, the hooks being adapted to releasably grasp a clothes hanger to carry a garment secured thereto;

an outer covering to enclose the fillable module, the covering having upper and lower portions and a length roughly twice the distance between the apex area and bottom edge of the module; and means for releasably attaching the upper and lower portions of the covering when brought proximate to one another upon folding along the horizontal fold region, thus enabling a coat or like garment to be placed over the resulting human form and folded in a manner which minimizes wrinkling of the garment during travel.

6. The travel system of claim 5, further including:

a flexible organizer panel extending downwardly from the back surface of the fillable module, the organizer panel including a plurality of user-accessible pockets, and wherein the covering is sized to contain both the module and organizer panel extending therefrom.

7. The travel system of claim 5, the fillable module being multi-compartmentalized.

8. The travel system of claim 5, further including a hook and carrying strap both pivotably attached at a single point associated with the apex area.

9. The travel system of claim 5, the carrying means including a shoulder strap having two outer edges of unequal length for better conformance to the slope of a user's shoulder.

* * * * *